US009693432B2

(12) United States Patent
Ando

(10) Patent No.: US 9,693,432 B2
(45) Date of Patent: Jun. 27, 2017

(54) LIGHTING DEVICE

(71) Applicant: Panasonic Intellectual Property Management Co., Ltd., Osaka (JP)

(72) Inventor: Tamotsu Ando, Osaka (JP)

(73) Assignee: Panasonic Intellectual Property Management Co., Ltd., Osaka (JP)

( * ) Notice: Subject to any disclaimer, the term of this patent is extended or adjusted under 35 U.S.C. 154(b) by 0 days.

(21) Appl. No.: 15/041,420

(22) Filed: Feb. 11, 2016

(65) Prior Publication Data

US 2016/0262245 A1 Sep. 8, 2016

(30) Foreign Application Priority Data

Mar. 5, 2015 (JP) ..... 2015-043528

(51) Int. Cl.

| | |
|---|---|
| ***H01Q 1/06*** | (2006.01) |
| ***H05B 37/02*** | (2006.01) |
| ***F21S 8/02*** | (2006.01) |
| *F21V 23/00* | (2015.01) |
| *F21Y 115/10* | (2016.01) |

(52) U.S. Cl.

CPC ..... *H05B 37/0272* (2013.01); *F21S 8/026* (2013.01); *F21V 23/008* (2013.01); *F21Y 2115/10* (2016.08)

(58) Field of Classification Search

CPC ..... H05B 37/0272; H05B 39/088
USPC ..... 315/291, 297, 307; 343/721
See application file for complete search history.

(56) References Cited

U.S. PATENT DOCUMENTS

| | | | | |
|---|---|---|---|---|
| 5,424,859 | A * | 6/1995 | Uehara | H04B 1/38 398/126 |
| 9,320,112 | B2 * | 4/2016 | Tabor | H05B 37/0218 |
| 2003/0090889 | A1 * | 5/2003 | Wacyk | H05B 37/0272 362/85 |
| 2005/0017908 | A1 * | 1/2005 | Saegrov | H04B 3/60 343/702 |
| 2007/0183133 | A1 * | 8/2007 | Buij | H04B 3/54 362/85 |
| 2010/0289703 | A1 * | 11/2010 | Huang | H01Q 9/04 343/702 |
| 2016/0165702 | A1 * | 6/2016 | Lai | H05B 37/0272 315/201 |

FOREIGN PATENT DOCUMENTS

| | | | |
|---|---|---|---|
| JP | 2002-343581 | A | 11/2002 |
| JP | 2007-227041 | A | 9/2007 |
| JP | 2007-287679 | A | 11/2007 |

(Continued)

*Primary Examiner* — Jason M Crawford
(74) *Attorney, Agent, or Firm* — Renner, Otto, Boisselle & Sklar, LLP

(57) ABSTRACT

A lighting device includes: a metal casing; a power supply circuit which is disposed in the metal casing and supplies power to a light source; an antenna disposed in the metal casing; a radio circuit which is disposed in the metal casing and receives a radio signal via the antenna; a control circuit which controls the power supply circuit according to the radio signal received by the radio circuit; at least one opening that communicatively connects an inside and an outside of the metal casing; and a line which is inserted in the at least one opening and insulated from the metal casing, the line being conductive and having open ends.

10 Claims, 7 Drawing Sheets

(56) References Cited

FOREIGN PATENT DOCUMENTS

| | | | |
|---|---|---|---|
| JP | 2007-533094 | A | 11/2007 |
| JP | 2009-134955 | A | 6/2009 |
| JP | 2012-174454 | A | 9/2012 |
| JP | 2012-227021 | A | 11/2012 |
| WO | WO 2005/101919 | A1 | 10/2005 |

* cited by examiner

LIGHTING DEVICE

CROSS REFERENCE TO RELATED APPLICATION

This application claims the benefit of priority of Japanese Patent Application Number 2015-043528 filed on Mar. 5, 2015, the entire content of which is hereby incorporated by reference.

BACKGROUND

1. Technical Field

The present disclosure relates to a lighting device capable of radio communication.

2. Description of the Related Art

In recent years, a lighting device which operates under control of a radio signal transmitted by a control device such as a remote controller has been used in various indoor and outdoor environments.

Japanese Unexamined Patent Application Publication (Translation of PCT Application) No. 2007-533094 discloses a lighting device including a wireless control interface for radio communication, such as a fluorescent light. The input of a receiver and the output of a transmitter of the wireless control interface are connected to one or more power source wires via a coupling capacitor or a Lecher-wire transformer. In operation, the one or more power source wires serve as an antenna of the lighting device. According to Japanese Unexamined Patent Application Publication (Translation of PCT Application) No. 2007-533094, the above-described configuration enables radio communication even when the receiver and the transmitter are disposed in a metal casing.

SUMMARY

One problem with the one or more power source wires disclosed by Japanese Unexamined Patent Application Publication (Translation of PCT Application) No. 2007-533094 is that, since the length of the one or more power source wires is not suitable for the radio frequency, the one or more power source wires are not capable of exerting an excellent performance as an antenna.

An object of the present disclosure is to provide a lighting device which improves the performance of an antenna located in a metal casing when a radio circuit and the antenna are disposed in the metal casing.

In order to achieve the above-described object, a lighting device to which a light source is attached according to an embodiment of the present disclosure includes: a metal casing; a power supply circuit which is disposed in the metal casing and supplies power to the light source; an antenna disposed in the metal casing; a radio circuit which is disposed in the metal casing and receives a radio signal via the antenna; a control circuit which controls the power supply circuit according to the radio signal received by the radio circuit; at least one opening that communicatively connects an inside and an outside of the metal casing; and a line which is inserted in the at least one opening and insulated from the metal casing, the line being conductive and having open ends and configured to operatively couple the radio signal from outside of the metal casing to the antenna inside the metal casing.

With the lighting device according to the present disclosure, it is possible to improve performance of an antenna located in a metal casing.

BRIEF DESCRIPTION OF DRAWINGS

The figures depict one or more implementations in accordance with the present teaching, by way of examples only, not by way of limitations. In the figures, like reference numerals refer to the same or similar elements.

DETAILED DESCRIPTION OF THE EMBODIMENT

The following describes in detail an embodiment according to the present disclosure, with reference to the drawings. It should be noted that an embodiment described below shows a specific example of the present disclosure. Thus, the numerical, values, shapes, materials, elements, the disposition and connection of the elements, and others described in the following embodiment are mere examples, and do not intend to limit the present disclosure. In addition, among the elements in the following embodiment, elements not recited in the independent claim which indicates the broadest concepts of the present disclosure are described as arbitrary elements. In addition, each diagram is a schematic diagram and not necessarily strictly illustrated.

Embodiment

First, a configuration example of a lighting system will be described.

Configuration Example of a Lighting System

Figure 1:
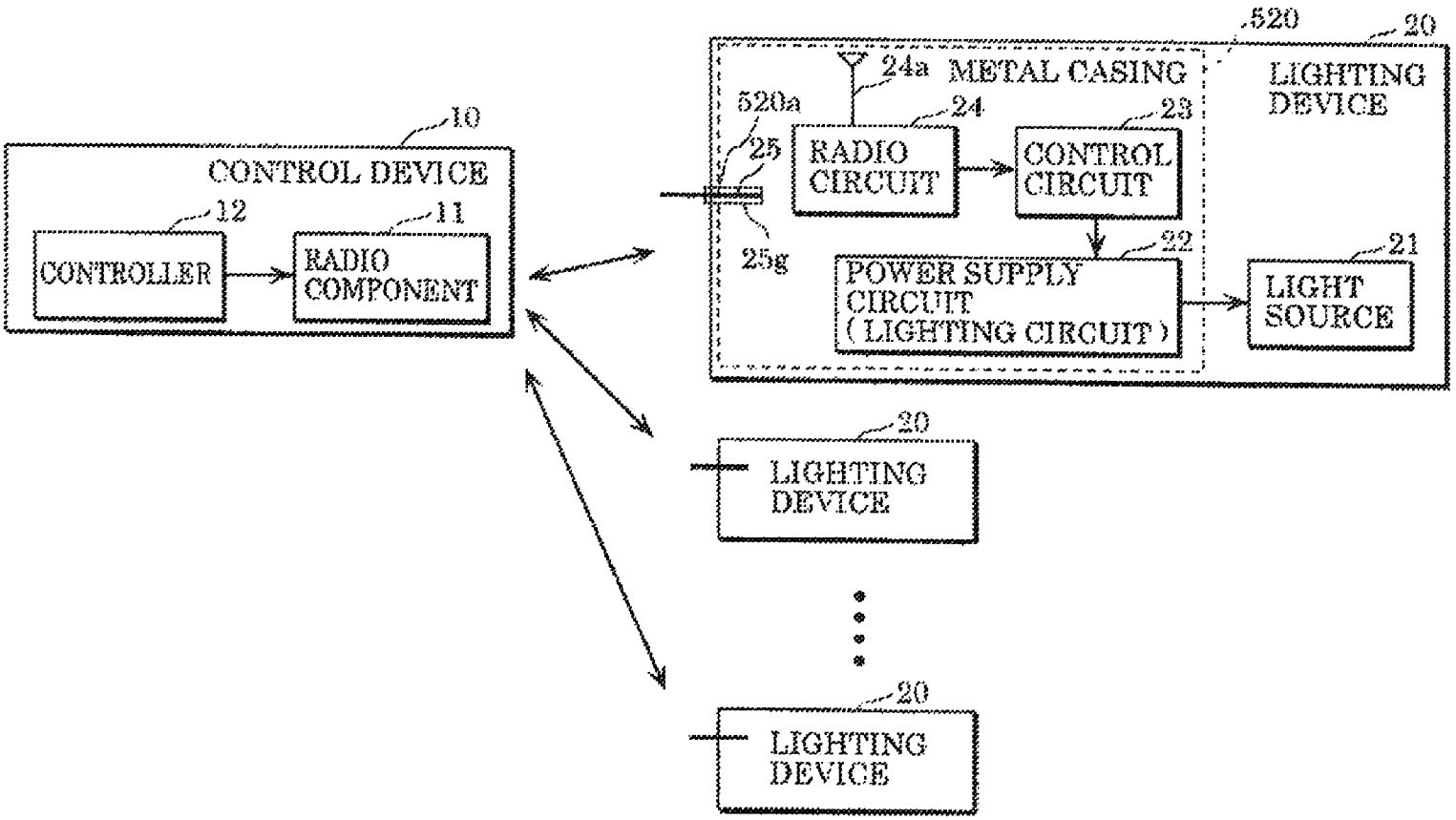
FIG. 1 is a block diagram illustrating a configuration example of a lighting system according to an embodiment.

FIG. 1 is a block diagram illustrating a configuration example of a lighting system according to an embodiment. The lighting system illustrated in FIG. 1 includes control device 10 and a plurality of lighting devices 20.

Control device 10 is, for example, a mobile tablet terminal device which controls each of lighting devices 20. Control device 10 thus includes radio component 11 and controller 12.

Radio component 11 performs radio communication with each of lighting devices 20. For example, radio component 11 transmits, to any of lighting devices 20, a command transmitted by controller 12, and receives a response from the any of lighting devices 20.

Controller 12 generates various commands for lighting devices 20, and transmits the commands to lighting devices 20 via radio component 11. Furthermore, controller 12 receives a response from lighting devices 20 via radio component 11. The various commands include, for example, commands for instructing turning on, turning off, dimming, toning, etc.

Each of lighting devices 20 includes: light source 21; power supply circuit 22; control circuit 23; radio circuit 24; antenna 24*a*; line 25, and guiding component 25*g*. Furthermore, dashed frame illustrated in FIG. 1 represents metal casing 520.

Metal casing 520 houses power supply circuit 22; control circuit 23; radio circuit 24; and antenna 24*a*. Metal casing 520, however, need only house at least radio circuit 24 and antenna 24*a*. Metal casing 520 is made of aluminum, for example, and includes at least one opening 520*a* penetrating through a surface of metal casing 520.

Opening 520*a* is defined in, for example, each of a plurality of surfaces which metal casing 520 includes. Opening 520*a* has a shape similar to a shape of a cross-section surface of line 25 or guiding component 25*g*. Opening 520*a* is a little larger in size than a size of the cross-section surface of line 25 or guiding component 25*g*, for holding line 25 or guiding component 25*g*.

Light source 21 includes as a light-emitting element, for example, an LED (light emitting diode), an organic EL (electro-luminescence) element, a fluorescent lamp, etc.

Power supply circuit 22 is a lighting circuit which is disposed in metal casing 520 and supplies power to light source 21.

Control circuit 23 is disposed in metal casing 520 and controls power supply circuit 22 according to a radio signal received by radio circuit 24.

Radio circuit 24 is disposed in metal casing 520 and receives a radio signal via antenna 24*a*. According to the present embodiment, a radio signal has a frequency in the UHF (ultra high frequency) band ranging from 300 MHz to 3 GHz.

Antenna 24*a* is disposed in metal casing 520 and is formed as a wiring pattern on, for example, a circuit board same as a circuit board of radio circuit 24.

Line 25 is a conductive line (such as a copper wire) having open ends, insulated from metal casing 520, and inserted in at least one opening 520*a*. Here, the following describes the meaning of the phrase "line having open ends" in more detail. Line 25 is, in other words, in a floating state. More specifically, line 25 is a conductive line having opened ends, and is not directly connected to other circuits located inside metal casing 520 and outside metal casing 520. However, line 25 is capable of resonating with a radio-frequency signal that is a radio signal, together with antenna 24*a*, and thus is electromagnetically coupled with antenna 24*a* in a high-frequency band. In this manner, line 25 assists antenna 24*a*. More specifically, line 25 inserted in opening 520*a* gives passage to a radio wave that is a radio signal, and thus reception performance and transmission performance of antenna 24*a* are improved. In other words, line 25 is an auxiliary antenna included, together with antenna 24*a*, in a single antenna. Line 25 may be a parasitic element or a passive radiator in relation to antenna 24*a*.

Line 25 may be a PVC (polyvinyl chloride) wire that is a copper line covered with vinyl chloride insulation, for example. The PVC line is also called a vinyl covered wire. Line 25 may be individually inserted in and held in opening 520*a*, or may be inserted in and held by guiding component 25*g* connected to opening 520*a*.

Guiding component 25*g* is a tubular member which guides line 25 to be inserted in opening 520*a*. Guiding component 25*g* has a first end connected to opening 520*a* and a second end positioned inside metal casing 520. Line 25 is inserted in and held by guiding component 25*g*. In installation work for lighting device 20, guiding component 25*g* facilitates and secures the process of inserting line 25, compared to the case where line 25 is individually inserted in opening 520*a*.

Configuration Example of Lighting Device

Next, a configuration example of lighting device 20 will be described.

Figure 2A:
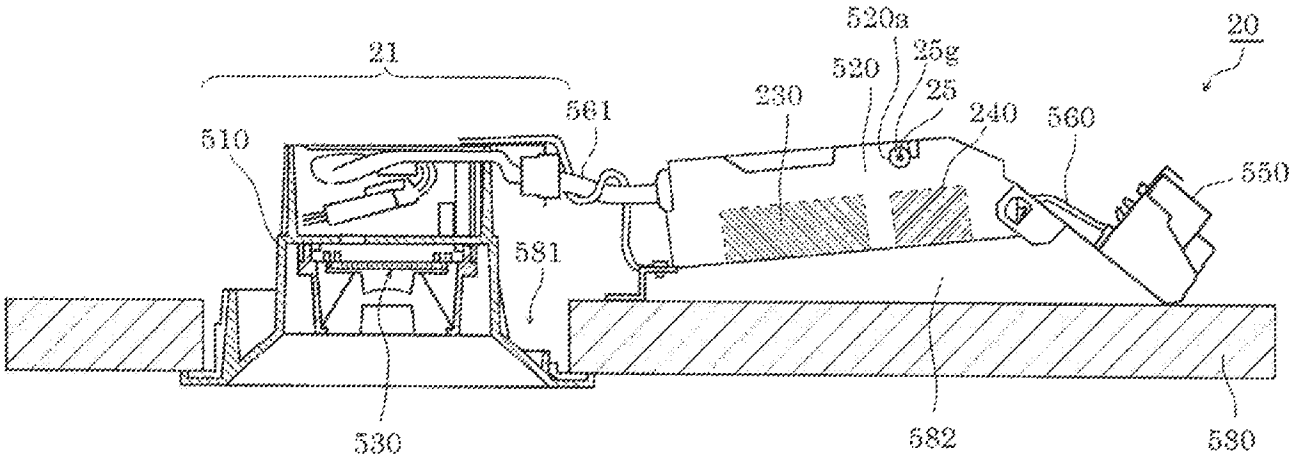
FIG. 2A is a cross-sectional view illustrating a configuration example of a lighting device according to the embodiment.
Figure 2B:
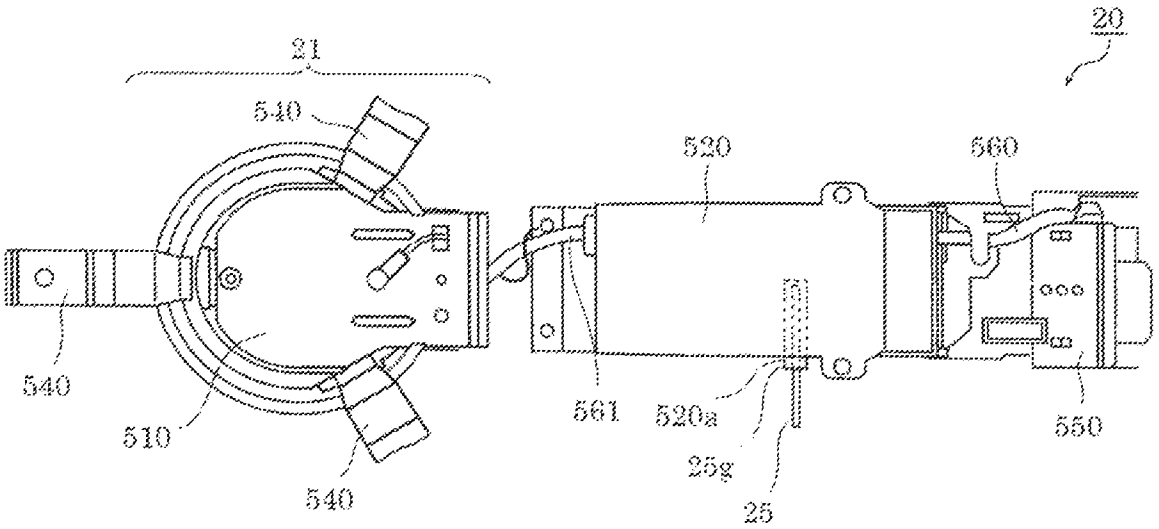
FIG. 2B is a top-view illustrating the configuration example of the lighting device according to the embodiment.

FIG. 2A is a cross-sectional view illustrating a configuration example of lighting device 20 according to the embodiment. FIG. 2B is a top-view illustrating the configuration example of lighting device 20 according to the embodiment.

Lighting device 20 illustrated in FIG. 2A and FIG. 2B is an embedded lighting device such as a downlight, which is mounted by being embedded in ceiling 580 of a house or the like, to emit light downward (to a floor or a wall).

As illustrated in FIG. 2A and FIG. 2B, lighting device 20 includes light source 21, metal casing 520, and attaching component 550. Light source 21 includes device body 510 in which light emitter 530 is mounted.

Metal casing 520 is mounted on a placement face to form space 582 between metal casing 520 and the placement face. The placement face is an upper surface of ceiling 580; that is, a back-side surface of the ceiling. Metal casing 520 is shaped by, for example, bending a metal plate component such as aluminum.

In FIG. 2A and FIG. 2B, metal casing 520 is a substantially cuboid casing. Power supply substrate 230 and radio substrate 240 are disposed in metal casing 520. Furthermore, metal casing 520 includes a side surface having opening 520*a*. Line 25 and guiding component 25*g* are inserted in opening 520*a*. It should be noted that opening 520*a* may be defined not only on one side surface but also in addition or in the alternative on other side surfaces, an upper surface, and a lower surface. In this manner, it is possible to select, from among a plurality of openings 520*a*, at least one opening 520*a* into which line 25 is inserted and which holds line 25.

Power supply substrate 230 includes power supply circuit 22 and control circuit 23 which are illustrated in FIG. 1. Power supply substrate 230 supplies power for turning on light emitter 530. Furthermore, power supply substrate 230 controls turning on, turning off, dimming, toning, etc. of light emitter 530.

Radio substrate 240 includes radio circuit 24 and antenna 24*a* which are illustrated in FIG. 1.

Lighting device 20 further includes attaching spring 540 and attaching component 550.

Light emitter 530 is a light-emitting module including a light-emitting element, and emits predetermined light. According to the present embodiment, light emitter 530 is a COB (chip on board) light-emitting module or a light-emitting module including an SMD (surface mounted device) LED (light emitting diode) element.

Device body 510 is a casing in which light emitter 530 is disposed, and is shaped into substantially a circular truncated cone. Device body 510 includes an outer circumference surface to which attaching spring 540 is mounted. In addition, a plurality of cooling fins which protrude outwardly may be disposed on the outer circumference surface of device body 510.

Attaching spring 540 is secured to the outer circumference surface of device body 510 and biased outwardly. Attaching spring 540 is used in attaching lighting device 20 (device body 510) to embedding hole 581.

Attaching component 550 is connected to a cable that is connected to a grid power (commercial power source) which is a supply source of AC power. Attaching component 550 supplies AC power obtained via the cable to power supply substrate 230 in metal casing 520, via cable 560. Attaching component 550 is disposed at an end of metal casing 520 in a longitudinal direction.

Cable 560 is a cable for supplying the AC power received by attaching component 550 to power supply substrate 230 in metal casing 520. Cable 561 is a cable for supplying power from power supply substrate 230 in metal casing 520 to light emitter 560 in device body 510.

Configuration Example of Metal Casing

Further, an example of a configuration of metal casing 520 will be described.

Figure 3:
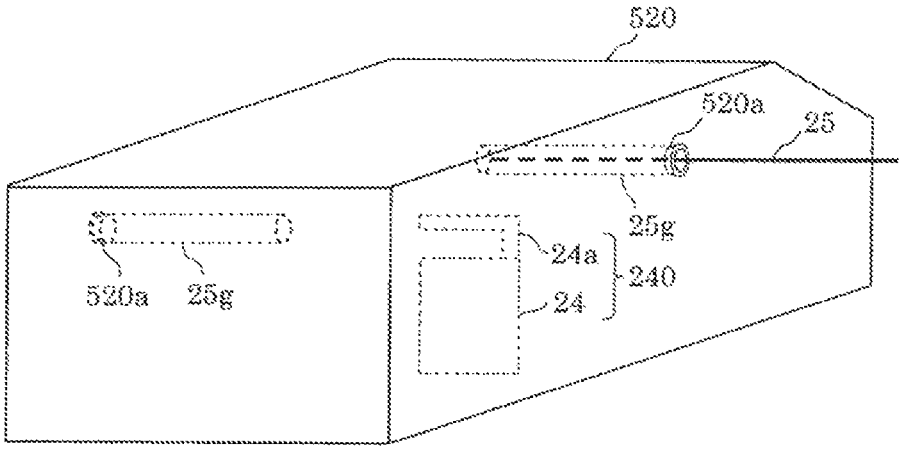
FIG. 3 is a perspective view illustrating a configuration example of a metal casing according to the embodiment.

FIG. 3 is a perspective view illustrating an example of a configuration of metal casing 520 according to the embodiment. In this example of a configuration, metal casing 520 includes opening 520*a* in one side surface and a side surface on the opposite side. A respective guiding component 25*g* is connected to each of openings 520*a*. Line 25 is inserted in and held by one of the two guiding components 25*g*.

In addition, radio circuit 24 and antenna 24*a* which are included in radio substrate 240 indicated by dashed lines are included in metal casing 520. Although line 25 and antenna 24*a* are not directly connected, line 25 serves as an auxiliary antenna, by disposing a part of line 25 inside metal casing 520 and the rest of line 25 outside metal casing 520. In other words, line 25 gives passage connecting an inside and an outside of metal casing 520 to a radio wave. As a result, this facilitates antenna 24*a* to more intensively resonate with a radio wave outside metal casing 520. Line 25 acts as a passive radiator to couple a radio wave emitted from antenna 24*a* from inside metal casing 520 to outside metal casing 520, or alternatively to couple a radio wave received from outside metal casing 520 to antenna 24*a* inside metal casing 520.

It should be noted that a positional relationship between antenna 24*a* and line 25 is not specifically restricted. More specifically, in a limited space of metal casing 520, whether a distance between antenna 24*a* and line 25 is large or small, or whether positions of antenna 24*a* and line 25 are parallel or skewed, makes a little difference, and thus the above-described positional relationship need not be specifically limited.

[Configuration Examples of Line and Guiding Component]

Next, a configuration example of line 25 and guiding component 25*g* will be described.

Figure 4A:
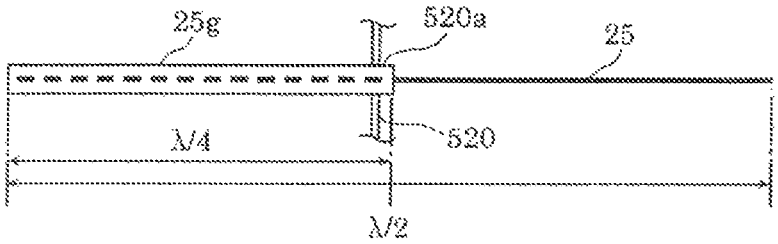
FIG. 4A is a diagram illustrating a configuration example of a line and a guiding component according to the embodiment.

FIG. 4A is a diagram illustrating a configuration example of line 25 and guiding component 25*g* according to the embodiment. FIG. 4A illustrates a state where a guiding component 25*g* and line 25 are held in opening 520*g* of metal casing 520.

In FIG. 4A, the length of line 25 corresponds to approximately $\lambda/2$, i.e., approximately one-half of the wavelength of a radio signal. The length of line 25 may be an arbitrary length. In order to implement antenna 24*a* with further improved performance, the length of line 25 may be one-half of the wavelength of a radio signal received by or transmitted to antenna 24*a*. When a radio signal has a frequency in the UHF band, the wavelength of the radio signal in the UHF band ranges from 1 in to 10 cm, and the length of line 25 ranges from 50 cm to 5 cm.

Guiding component 25*g* has a first end connected to opening 520*a* and a second end positioned inside metal casing 520. Guiding component 25*g* maintains line 25 in a manner that line 25 remains electrically isolated, i.e., electrically floating. Guiding component 25*g* is made of insulating material. In FIG. 4A, the length of guiding component 25*g* corresponds to approximately $\lambda/4$, i.e., approximately one-quarter of the wavelength of a radio signal. This means that, with the above-described length of guiding component 25*g*, approximately one-half of line 25 is positioned inside metal casing 520. The length of guiding component 25*g* may be an arbitrary length as long as guiding component 25*g* is shorter than line 25. In order to implement antenna 24*a* with further improved performance, the length of guiding component 25*g* may be approximately one-quarter of the wavelength.

In addition, one of the two ends of guiding component 25*g* which is positioned inside metal casing 520 may be closed. This configuration facilitates and secures positioning of line 25 in the process of inserting line 25 into guiding component 25*g*. In other words, it is possible to easily and reliably optimize the length of line 25 to be disposed inside metal casing 520.

Figure 4B:
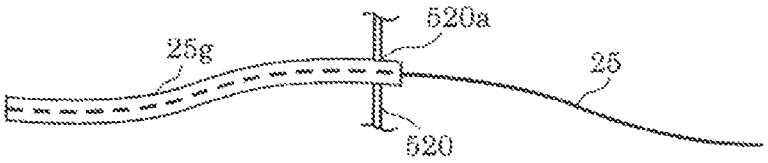
FIG. 4B is a diagram illustrating another configuration example of the line and the guiding component according to the embodiment.

FIG. 4B is a diagram explaining line 25 and guiding component 25*g* according to the embodiment. As illustrated in FIG. 4B, guiding component 25*g* is flexible. When line 25 is the PVC line, line 25 is also flexible. This configuration facilitates incorporating guiding component 25*g* into metal casing 520 even when metal casing 520 is compact. Furthermore, interference between other components in metal casing 520 and guiding component 25*g* is easily avoided.

Moreover, it is possible to change directivity of line 25 as an auxiliary antenna, by changing an orientation of a portion of line 25 which is disposed outside metal casing 520.

Next, a modification example of line 25 will be described.

Figure 4C:
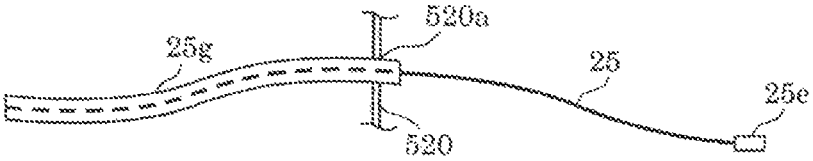
FIG. 4C is a diagram illustrating a modification example of the line and the guiding component according to the embodiment.
Figure 4D:
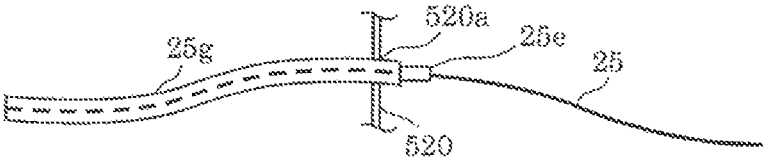
FIG. 4D is a diagram illustrating another modification example of the line and the guiding component according to the embodiment.

FIG. 4C is a diagram illustrating a modification example of line 25 and guiding component 25*g* according to the embodiment. In FIG. 4C, element 25*e* is connected to an end of line 25. Line 25 and element 25*e* are connected in series. FIG. 4D is a diagram illustrating a modification example of line 25 and guiding component 25*g* according to the embodiment. In FIG. 4D, element 25*e* is inserted to line 25. Part of line 25, element 25*e*, and remaining part of line 25 are connected in series.

Element 25*e* is not directly connected to any circuit inside metal casing 520 and any circuit outside metal casing 520 other than line 25, and is insulated from metal casing 520. Element 25*e* is an inductor or a capacitor.

An inductor serves as an extension coil. More specifically, when element 25*e* is an inductor, it is possible to reduce the physical length of line 25 as an auxiliary antenna.

A capacitor serves as a loading condenser. More specifically, when element 25*e* is a capacitor, it is possible to extend the physical length of line 25 as an auxiliary antenna.

For example, it is possible to prepare in advance a plurality of lines 25 having different physical lengths, using a plurality of elements 25*e* having different inductances or capacitances. In installation work of lighting device 20, it is possible to select line 25 having an appropriate length from among a plurality of lines 25, according to the size of metal casing 520, a space, an environment, etc., for installing lighting device 20, and the like. For example, in the case where metal casing 520 is compact or a sufficient space for placing line 25 inside metal casing 520 cannot be ensured, line 25 having an inductor is useful.

In addition, element 25*e* illustrated in FIG. 4D serves also as a stopper when inserting line 25 into guiding component 25*g*. This configuration enables appropriately and easily ensuring the length of line 25 inside metal casing 520 and the length of line outside metal casing 520, even when one of the ends of guiding component 25*g* which is disposed in metal casing 520 is open.

It should be noted that, although element 25*e* is disposed outside metal casing 520 in FIG. 4C and FIG. 4D, element 25*e* may be disposed inside metal casing 520.

Improvement of Performance with Use of Line 25

Next, improvement of performance of antenna 24*a* with use of line 25 will be described based on experiment data.

Figure 5:
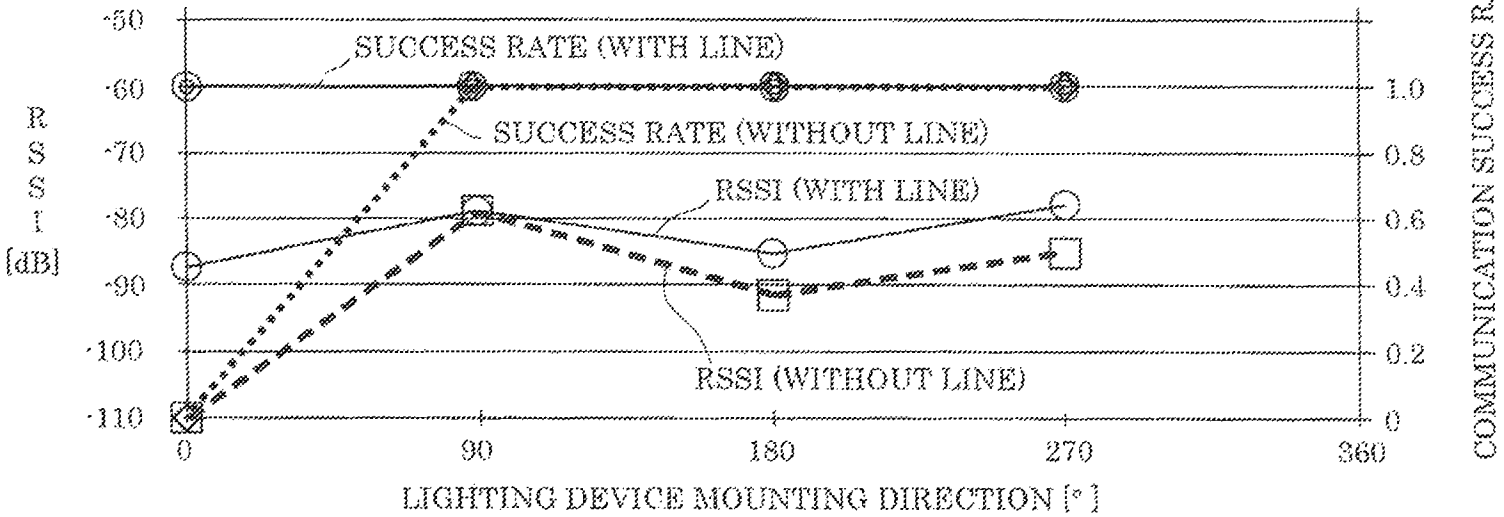
FIG. 5 is a diagram illustrating an RSSI (received signal strength indicator) and a communication success rate of the lighting device according to the embodiment.

FIG. 5 is a diagram illustrating an RSSI (received signal strength indicator) and a communication success rate of lighting device 20 according to the embodiment.

In FIG. 5, the horizontal axis indicates an attachment angle of lighting device 20 when lighting device 20 illustrated in FIG. 2B is rotated about light source 21 on a flat surface parallel to ceiling 580. The attachment angle at the time of starting measurement is set at 0 degrees. The vertical axis on the left indicates an RSSI, i.e., a received signal strength indicator. The vertical axis on the right indicates a communication success rate which is a rate of succeeding communication in which no packet error of a radio signal has occurred. When the communication success rate is 0, errors occurred in all of the packets. When the communication success rate is 1, there was no packet error.

The dashed line including squares as measurement points indicates the RSSI when line 25 is not included. The dotted line including rhomboids as measurement points indicates the communication success rate when line 25 is not included.

When line 25 is not included, the RSSI is −110 dB and the communication success rate is 0 with the attachment angle being 0 degrees, and thus radio communication is impossible.

When line 25 is not included, the RSSI falls within the range from −90 dB to −80 dB and the communication success rate is 1 with the attachment angle being 90 degrees, 180 degrees, and 270 degrees, and thus radio communication is possible without any trouble.

The solid line including circles as measurement points indicates the RSSI when a single line 25 is included. The bold line including double circles as measurement points indicates the communication success rate when a single line 25 is included.

When the case where line 25 is included and the case where line 25 is not included are compared, the RSSI improves from −110 to −87 and the communication success rate improves from 0 to 1, with the attachment angle being 0 degrees. More specifically, when the attachment angle is 0 degrees, the communication improves from a disabled state to a non-trouble state.

When the case where line 25 is included and the case where line 25 is not included are compared, the RSSI improves from the range from −90 to −80 to the range from −85 to −80, with the attachment angle being 90 degrees, 180 degrees, and 270 degrees. In addition, the communication success rate with the above-described attachment angles is 1 regardless of presence or absence of line 25, and thus communication is possible without any trouble.

In FIG. 5, when line 25 is not included, radio communication is impossible with the attachment angle being 0 degrees, which is a dead angle. However, the dead angle disappears as a result of adding a single line 25. Furthermore, the RSSI is improved with the attachment angle being 0 degrees and 180 degrees, by adding a single line 25.

As described above, line 25 improves the performance of antenna 24*a*. FIG. 5 describes the advantageous effect that the dead angle which disables radio communications disappears, enabling communication without any trouble at any attachment angles.

It should be noted that, although FIG. 5 illustrates an example case where lighting device 20 includes only a single line 25, significant difference was not found in the case where lighting device 20 includes a plurality of lines 25.

Furthermore, there is the case where radio communication is carried out without any trouble even when line 25 is not included as in the case of attachment angles being 90 degrees and 270 degrees in the example of FIG. 5. Line 25 may be included as an optional extra when the above-described advantageous effect can be obtained by adjusting the attachment angles.

Advantageous Effects, etc.

As described above, with the lighting device according to the embodiment, it is possible to improve the performance of antenna 24*a* disposed inside metal casing 52.

From the perspective of pursuit of design for an external view of a lighting device, antenna 24*a* is generally made unnoticeable. For example, in the case of a downlight which is a recessed type ceiling light as the lighting device illustrated in FIG. 2A and FIG. 2B, an antenna is disposed, in some cases, in a ceiling where the antenna becomes invisible after installation, as a measure to avoid impairing the external view of the lighting device. However, from the perspective of cost reduction, radio circuit 24 and antenna 24*a* are included together with a lighting circuit (i.e., power supply circuit 22 in FIG. 1) for illumination which is the main function, as illustrated in FIG. 1. Generally, a lighting circuit (i.e., power supply circuit 22) is dispose in metal casing 520. When line 25 is not included, antenna 24*a* emits or receives a radio wave thorough an opening of metal casing 520. In this case, emission efficiency or reception efficiency of the antenna for a radio wave decreases, disabling communication in some cases. In the lighting device according to the present embodiment, line 25 is disposed in opening 520*a* of metal casing 520. Line 25 gives passage to a radio wave, and improves the performance of antenna 24*a*.

Figure 6:
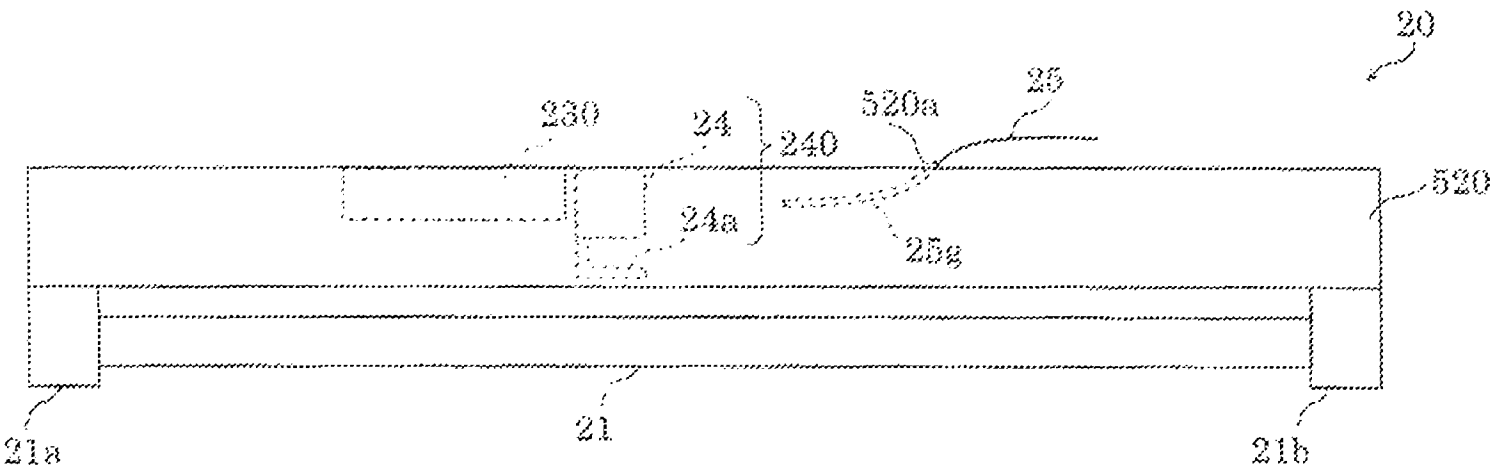
FIG. 6 is a side view illustrating another configuration example of a lighting device according to the embodiment.

It should be noted that lighting device 20 is not limited, to a downlight illustrated in FIG. 2A and FIG. 2B. FIG. 6 is a side view illustrating another configuration example of a lighting device according to the embodiment. Lighting device 20 illustrated in FIG. 6 includes light source 21 having a straight-tube light emitter and, for example, a fluorescent lamp or a plurality of LED devices. Light source 21 is held by sockets 21*a* and 21*b* and supplied with power. Sockets 21*a* and 21*b* are secured to metal casing 520 having a cuboid shape. Power supply substrate 230 and radio substrate 240 are disposed in metal casing 520. Power supply substrate 230 includes power supply circuit 22 and control circuit 23 which are illustrated in FIG. 1. Radio substrate 240 includes radio circuit 24 and antenna 24*a* which are illustrated in FIG. 1. Metal casing 520 includes an upper surface having opening 520*a*. Line 25 and guiding component 25*g* are inserted in opening 520*a*. It should be noted that opening 520*a* may be defined not only in the upper surface but also in a side surface and a lower surface.

The configuration example illustrated in FIG. 6 also produces advantageous effects same as the advantageous effects produced by the configuration examples illustrated in FIG. 2A and FIG. 2B. In other words, line 25 improves the performance of antenna 24*a*.

As described above, lighting device 20 according to the embodiment includes: metal casing 520; power supply circuit 22 which is disposed in metal casing 520 and supplies power to light source 21; antenna 24*a* disposed in metal casing 520; radio circuit 24 which is disposed in metal casing 520 and receives a radio signal via antenna 24*a*; control circuit 23 which controls power supply circuit 22 according to the radio signal received by radio circuit 24; at least one opening 520*a* that communicatively connects an inside and an outside of metal casing 520; and line 25 which is inserted in the at least one opening 520*a* and insulated from metal casing 520, line 25 being conductive and having open ends.

With this configuration, it is possible to improve the performance of an antenna disposed in a metal casing.

Here, lighting device 20 may further include guiding component 25*g* having a tubular shape, wherein guiding component 25*g* may have a first end connected to one of the at least one opening 520*a* and a second end positioned inside metal casing 520, and line 25 may be inserted in and held by guiding component 25*g*.

With this configuration, it is possible to facilitate and secure the process of inserting line 25 into guiding component 25*g*.

Here, line 25 may be detachable from guiding component 25*g*.

With this configuration, it is possible to dispose a line at an appropriate location according to a placement situation.

Here, guiding component 25*g* may be flexible

With this configuration, it is possible to easily avoid interference between other components in metal casing 520 and guiding component 25*g*.

Here, line 25 may have a length corresponding to approximately one-half of a wavelength of the radio signal.

With this configuration, it is possible to further improve the performance of antenna 24*a*.

Here, guiding component 25*g* may have a length corresponding to approximately one-quarter of a wavelength of the radio signal.

With this configuration, it is possible to further improve the performance of antenna 24*a*.

Here, the second end of guiding component 25*g* may be closed.

With this configuration, it is possible to optimally position line 25 by simply inserting line 25 into the guiding component 25*g* to reach an end of guiding component 25*g* in the process of inserting line 25 into guiding component 25*g*.

Here, the at least one opening 520*a* may include a plurality of openings 520*a*, and the plurality of openings 520*a* may be defined in different surfaces of metal casing 520.

With this configuration, it is possible to select an opening which is optimal for improving an antenna performance with use of line 25 according to a placement situation of a lighting device.

Here, lighting device 20 may further include either one of an inductor and a capacitor connected in series to an end of line 25 or inserted in series in line 25. The one of an inductor and a capacitor is free of direct connection with any circuit inside metal casing 520 and any circuit outside metal casing 520 other than line 25, and may be insulated from metal casing 520.

With this configuration, it is possible to determine the length of line 25 appropriately, according to a size of metal casing 520, a placement space, placement situation, etc., of lighting device 20, and the like.

Here, the radio signal may have a frequency in UHF (ultra high frequency) band.

With this configuration, it is possible to determine an effective length of a line to a length in a range from 50 cm to 5 cm.

Although the lighting device according to the present disclosure is described based on the above-described embodiment, the present invention is not limited to the above-described embodiment. Other forms in which various modifications apparent to those skilled in the art are applied to the present embodiment or forms in which some elements according to the embodiment and modification examples are arbitrarily combined within the scope of the present discloser are also included within the scope of the present disclosure unless such changes and modifications depart from the scope of the present disclosure.

While the foregoing has described what are considered to be the best mode and/or other examples, it is understood that various modifications may be made therein and that the subject matter disclosed herein may be implemented in various forms and examples, and that they may be applied in numerous applications, only some of which have been described herein. It is intended by the following claims to claim any and all modifications and variations that fall within the true scope of the present teachings.

What is claimed is:

1. A lighting device to which a light source is attached comprising:

a metal casing;

a power supply circuit which is disposed in the metal casing and supplies power to the light source;

an antenna disposed in the metal casing;

a radio circuit which is disposed in the metal casing and receives a radio signal via the antenna;

a control circuit which controls the power supply circuit according to the radio signal received by the radio circuit;

at least one opening that communicatively connects an inside and an outside of the metal casing; and a line which is inserted in the at least one opening and insulated from the metal casing, the line being conductive and having open ends, and configured to operatively couple the radio signal from outside of the metal casing to the antenna inside the metal casing.

2. The lighting device according to claim 1, further comprising a guiding component having a tubular shape, wherein the guiding component has a first end connected to one of the at least one opening and a second end positioned inside the metal casing, and the line is inserted in and held by the guiding component.

3. The lighting device according to claim 2, wherein the line is detachable from the guiding component.

4. The lighting device according to claim 2, wherein the guiding component is flexible.

5. The lighting device according to claim 2, wherein the guiding component has a length corresponding to approximately one-quarter of a wavelength of the radio signal.

6. The lighting device according to claim 2, wherein the second end of the guiding component is closed.

7. The lighting device according to claim 1, wherein the line has a length corresponding to approximately one-half of a wavelength of the radio signal.

8. The lighting device according to claim 1, wherein the at least one opening comprises a plurality of openings, and the plurality of openings are defined in different surfaces of the metal casing.

9. The lighting device according to claim 1, further comprising either one of an inductor and a capacitor connected in series to an end of the line or inserted in series in the line, wherein the one of an inductor and a capacitor is free of direct connection with any circuit inside the metal casing and any circuit outside the metal casing other than the line, and is insulated from the metal casing.

10. The lighting device according to claim 1, wherein the radio signal has a frequency in UHF (ultra high frequency) band.

* * * * *